US009139340B2

(12) United States Patent
Ackerman et al.

(10) Patent No.: US 9,139,340 B2
(45) Date of Patent: Sep. 22, 2015

(54) RECLOSABLE POUCH WITH AN ELONGATE CLOSURE MECHANISM AND A METHOD OF CLOSING SUCH A POUCH

(71) Applicant: S.C. Johnson & Son, Inc., Racine, WI (US)

(72) Inventors: Bryan L. Ackerman, Freeland, MI (US); James C. Pawloski, Bay City, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 14/040,905

(22) Filed: Sep. 30, 2013

(65) Prior Publication Data

US 2014/0029874 A1 Jan. 30, 2014

Related U.S. Application Data

(62) Division of application No. 12/455,205, filed on May 29, 2009, now Pat. No. 8,578,572.

(51) Int. Cl.

| | |
|---|---|
| ***B65D 33/16*** | (2006.01) |
| ***A44B 1/04*** | (2006.01) |
| ***B65D 33/24*** | (2006.01) |
| ***B65D 33/25*** | (2006.01) |

(52) U.S. Cl.

CPC ..... *B65D 33/24* (2013.01); *B65D 33/255* (2013.01); *Y10T 24/45168* (2015.01)

(58) Field of Classification Search

CPC ..... B65D 33/2508; A44B 19/16

USPC ..... 383/63, 61.2; 24/399, 400, 585.11, 24/585.12, DIG. 39, DIG. 40

See application file for complete search history.

(56) References Cited

U.S. PATENT DOCUMENTS

| | | | |
|---|---|---|---|
| 3,149,772 | A | 9/1964 | Olsson |
| 3,237,844 | A | 3/1966 | Hughes |
| 4,479,244 | A | 10/1984 | Ausnit |
| 4,586,319 | A | 5/1986 | Ausnit |
| 4,736,496 | A | 4/1988 | Fisher et al. |
| 4,741,789 | A | 5/1988 | Zieke et al. |
| 4,755,248 | A | 7/1988 | Geiger et al. |
| 4,807,300 | A | 2/1989 | Ausnit et al. |
| 4,822,539 | A | 4/1989 | Tilman et al. |
| 4,929,487 | A | 5/1990 | Tilman et al. |
| 5,009,828 | A | 4/1991 | McCree |
| 5,012,561 | A | 5/1991 | Porchia et al. |
| 5,067,822 | A | 11/1991 | Wirth et al. |
| 5,070,584 | A | 12/1991 | Dais et al. |

(Continued)

*Primary Examiner* — Jes F Pascua

(57) ABSTRACT

A reclosable pouch having a resealable mouth and an elongate closure mechanism. The closure mechanism includes a pair of interlocking members extending from a first surface of a first base member that are parallel to each other with a space therebetween. The pair of interlocking members has constant profiles between opposite ends. A plurality of partial indentations extends longitudinally along a second surface of the first base member at positions opposite to the space between the pair of interlocking members. A pair of interlocking members extends from a surface of a second base member and are parallel to each other with a space therebetween. The pair of interlocking members each has constant profiles between opposite ends. The pair of interlocking members extending from the first base member are configured to interlock with the pair of interlocking members extending from the second base member, in order to resealably close the mouth.

8 Claims, 3 Drawing Sheets

(56) References Cited

U.S. PATENT DOCUMENTS

| | | | | |
|---|---|---|---|---|
| 5,138,750 | A | 8/1992 | Gundlach et al. | |
| 5,211,481 | A | 5/1993 | Tilman | |
| 5,259,904 | A | 11/1993 | Ausnit | |
| 5,307,552 | A | 5/1994 | Dais et al. | |
| 5,382,094 | A | 1/1995 | Ausnit | |
| 5,478,228 | A | 12/1995 | Dais et al. | |
| 5,509,734 | A | 4/1996 | Ausnit | |
| 5,722,128 | A | 3/1998 | Toney et al. | |
| 5,774,955 | A | 7/1998 | Borchardt et al. | |
| 5,791,783 | A | 8/1998 | Porchia et al. | |
| 5,814,896 | A | 9/1998 | Araki | |
| 6,021,557 | A | 2/2000 | Dais et al. | |
| 6,386,762 | B1 | 5/2002 | Randall et al. | |
| 6,592,260 | B1 | 7/2003 | Randall et al. | |
| 6,594,872 | B2 | 7/2003 | Cisek | |
| 6,692,147 | B2 | 2/2004 | Nelson | |
| 6,877,898 | B2 | 4/2005 | Berich et al. | |
| 6,955,465 | B2 | 10/2005 | Machacek et al. | |
| 6,962,439 | B2 | 11/2005 | Taheri | |
| 7,004,632 | B2 | 2/2006 | Hamilton et al. | |
| 7,137,736 | B2 | 11/2006 | Pawloski et al. | |
| 7,270,479 | B2 | 9/2007 | Nelson | |
| 7,334,682 | B2 | 2/2008 | Goepfert | |
| 7,410,298 | B2 | 8/2008 | Pawloski | |
| 7,543,361 | B2 | 6/2009 | Borchardt et al. | |
| 7,611,284 | B2 | 11/2009 | Borchardt et al. | |
| 7,674,040 | B2 | 3/2010 | Dowd et al. | |
| 7,942,577 | B2 | 5/2011 | Fraser et al. | |
| 8,070,359 | B2 | 12/2011 | Taheri | |
| 8,075,186 | B2 * | 12/2011 | Borchardt et al. | 383/63 |
| 8,157,444 | B2 | 4/2012 | Broering et al. | |
| 8,192,085 | B2 * | 6/2012 | Pawloski et al. | 383/65 |
| 8,469,592 | B2 * | 6/2013 | Pawloski | 383/63 |
| 8,578,572 | B2 * | 11/2013 | Ackerman et al. | 24/585.12 |
| 8,727,620 | B2 * | 5/2014 | Dais et al. | 383/63 |
| 2005/0205455 | A1 | 9/2005 | Harrison | |
| 2005/0281492 | A1 * | 12/2005 | Turvey et al. | 383/64 |
| 2007/0154118 | A1 | 7/2007 | Tilman et al. | |
| 2007/0206888 | A1 | 9/2007 | Chang | |
| 2007/0280563 | A1 | 12/2007 | Ausnit | |
| 2008/0137995 | A1 | 6/2008 | Fraser et al. | |
| 2008/0159662 | A1 | 7/2008 | Dowd et al. | |
| 2008/0285897 | A1 | 11/2008 | Taheri | |
| 2009/0232422 | A1 | 9/2009 | Broering et al. | |
| 2011/0044566 | A1 | 2/2011 | Fish et al. | |
| 2012/0027322 | A1 * | 2/2012 | Ackerman | 383/64 |

* cited by examiner

RECLOSABLE POUCH WITH AN ELONGATE CLOSURE MECHANISM AND A METHOD OF CLOSING SUCH A POUCH

CROSS REFERENCE TO RELATED APPLICATIONS

This application is a divisional application of U.S. patent application Ser. No. 12/455,205, filed on May 29, 2009 now U.S. Pat. No. 8,578,572, and published as U.S. Patent Application Publication No. 2010/0303390 A1 on Dec. 2, 2010.

REFERENCE REGARDING FEDERALLY SPONSORED RESEARCH OR DEVELOPMENT

Not applicable.

SEQUENTIAL LISTING

Not applicable.

FIELD OF THE INVENTION

The present invention relates to a reclosable thermoplastic pouch with an elongate closure mechanism and a method of closing such a pouch.

BACKGROUND

A thermoplastic pouch having a resealable closure mechanism applied longitudinally across a mouth thereof to allow repeated opening and closing of the pouch is known in the art. The closure mechanism can include multiple pairs of interlocking closure profiles, which can he difficult to seal and/or can cause consternation in a user in not knowing whether the multiple pairs of interlocking closure profiles have been properly sealed. It is, therefore, desirable to provide a reclosable closure mechanism for a thermoplastic pouch that includes a tactile guide path for a user's fingers, to assure proper sealing of the closure mechanism. In the past, there have been attempts to provide a tactile guide for a closure mechanism on a pouch, for various reasons.

For example, one thermoplasiic pouch has front and rear walls and a single pair of mutually interlocking opposing rib and groove closure elements disposed across a mouth of the pouch, Outer surfaces of the walls are roughened coextensive with and over the rib and groove elements, to provide a series of ridges with valleys therebetween that inhibit easy sliding of a user's lingers along the ridges and valleys, in order to facilitate a user's application of force tangential to the outer surfaces, in order to open the bag by displacing the opposing rib and groove elements tangentially past one another.

Another thermoplastic pouch has a powder-resistant flexible zipper, wherein the flexible zipper includes a line of longitudinally spaced apart apertures that extend completely through first and second base members of the zipper. The apertures are disposed between spaced apart pairs of interlocking hood members in order to allow powder trapped between the interlocking members to pass through the base member. In allowing powder to pass through the zipper, however, the apertures may diminish the sealing integrity of the zipper, especially if the pair of interlocking members interior to the apertures should inadvertently open.

A further thermoplastic pouch has a double profile closure mechanism disposed across a mouth of the pouch. External ridges are disposed on the pouch running parallel to and between the double profiles. Alternatively, or in addition to the external guide ridges, one or more internal ridges is disposed on the pouch running parallel to the double profiles. The internal and/or external guide ridges assist in alignment of the closure mechanism to facilitate closing thereof. The ridges disposed on the pouch require the addition of extra material to the pouch, which may add to die cost to manufacture the pouch.

The tactile guide path disclosed herein may overcome some of the drawbacks with the known tactile guide arrangements by providing a guide path for a user's lingers on a multiple zipper closure mechanism, without sacrificing the sealing integrity of the closure mechanism. Further, the tactile guide path may be manufactured in a post-production process without the addition of extra material to the pouch.

SUMMARY

In one aspect of the present invention, an elongate resealable closure mechanism includes a first base member and a second base member, wherein each of the first and second base members extends longitudinally between opposite ends thereof. First and second parallel spaced apart pairs of opposing interlocking members extend longitudinally between the opposite ends and project from opposing interior surfaces of the base members. A plurality of partial indentations extends longitudinally along an exterior surface of the first base member between the first and second pairs of opposing interlocking members.

In another aspect, the present invention provides a reclosable pouch in combination with an elongate closure mechanism disposed longitudinally across the mount for resealably closing the mouth. The elongate closure mechanism includes a first elongate base member disposed on one side of the month and a second elongate base member disposed on an opposite side of the mouth, wherein an interior surface of the first base member laces an interior surface of the second base member. A pair of opposing interlocking members projects from the opposing interior surfaces of the first and second base members and extends longitudinally across the mouth. A plurality of partial indentations is disposed along an exterior surface of the first base member, wherein the plurality of partial indentations extends longitudinally along the closure mechanism adjacent to the pair of opposing interlocking members and on a side thereof opposite to the mouth.

In a further aspect of the present invention, a method of closing a pouch is disclosed, the pouch including an elongate resealable closure mechanism for resealably closing a mouth to an interior of the pouch, the closure mechanism comprising a first base member and a second base member, wherein each of the first and second base members extends longitudinally along the mouth between opposite ends thereof first and second parallel spaced apart pairs of opposing interlocking members projecting from opposing interior surfaces of the base members, and a first plurality of partial indentations extending longitudinally along an exterior surface of the first base member, wherein the plurality of partial indentations is disposed between the first and second pairs of opposing interlocking members, and the method includes the steps of grasping the closure mechanism between a first finger and a second finger, locating the first finger between the first and second pairs of interlocking members by feeling whether the first finger is engaged against the first plurality of partial indentations, and locating the second finger on an exterior surface of the second base opposite to the first finger. The method further includes the steps of forcing the first and second opposing lingers together to locally occlude the first and second pairs of opposing interlocking members therebetween, sliding the first and second opposing fingers along the closure mechanism with the first and second fingers forced together, and maintaining the first finger between the first and second pairs of opposing interlocking members while performing the sliding step by feeling the first plurality of partial indentations with the first finger, whereby the first and second pairs of opposing interlocking members are occluded along the length thereof and the mouth is sealed.

BRIEF DESCRIPTION OF THE DRAWINGS

Other aspects and advantages of the present disclosure will become apparent upon consideration of the following detailed description, wherein similar structures have similar reference numbers.

DETAILED DESCRIPTION

Figure 1:
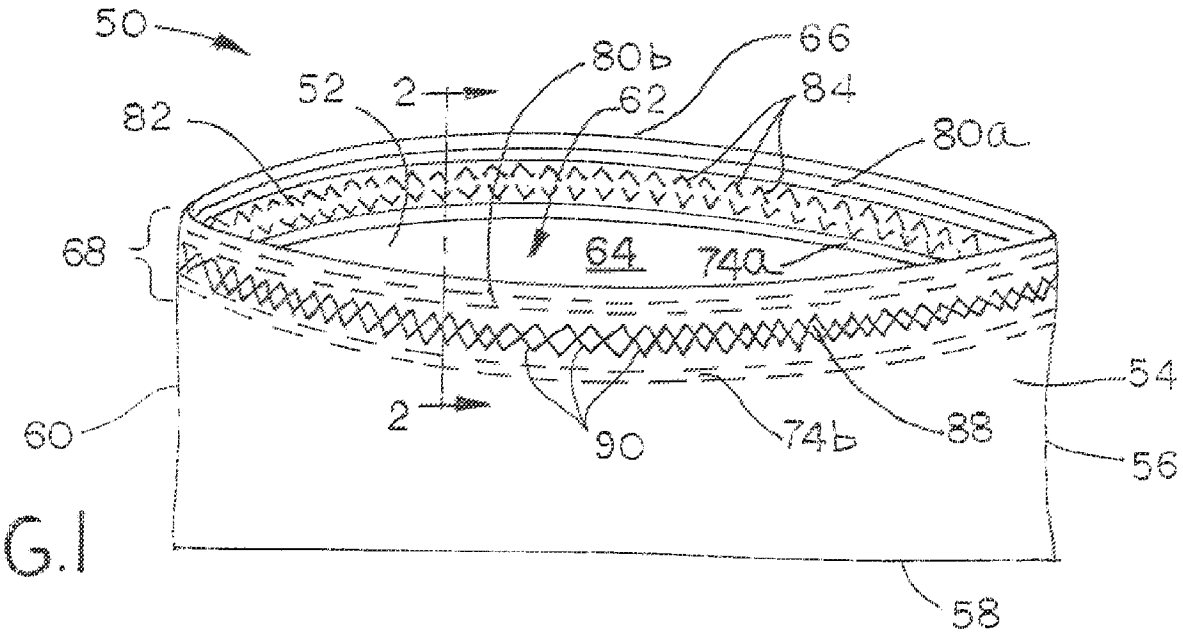
FIG. 1 is an isometric view of a pouch including a closure mechanism according to one aspect of the invention.

FIG. 1 illustrates a reclosable pouch 50 having a first sidewall 52 and a second sidewall 54 that are connected by, for example, folding, heat sealing, and/or an adhesive, along three peripheral edges 56, 58, 60 to define an interior space 62 between the first and second sidewalls 52, 54, and a mouth 64 along a top edge 66 where the first and second sidewalls 52, 54 are not connected, so as to allow access to the interior space 62. An elongate closure mechanism 68 is disposed along the first and second sidewalls 52, 54 across the mouth 64, extending longitudinally between the peripheral edge 56 and the peripheral edge 60 of the pouch 50, to allow the mouth 64 to be repeatedly occluded and deoccluded, thereby respectively sealing and unsealing the mouth 64.

Figure 2B:
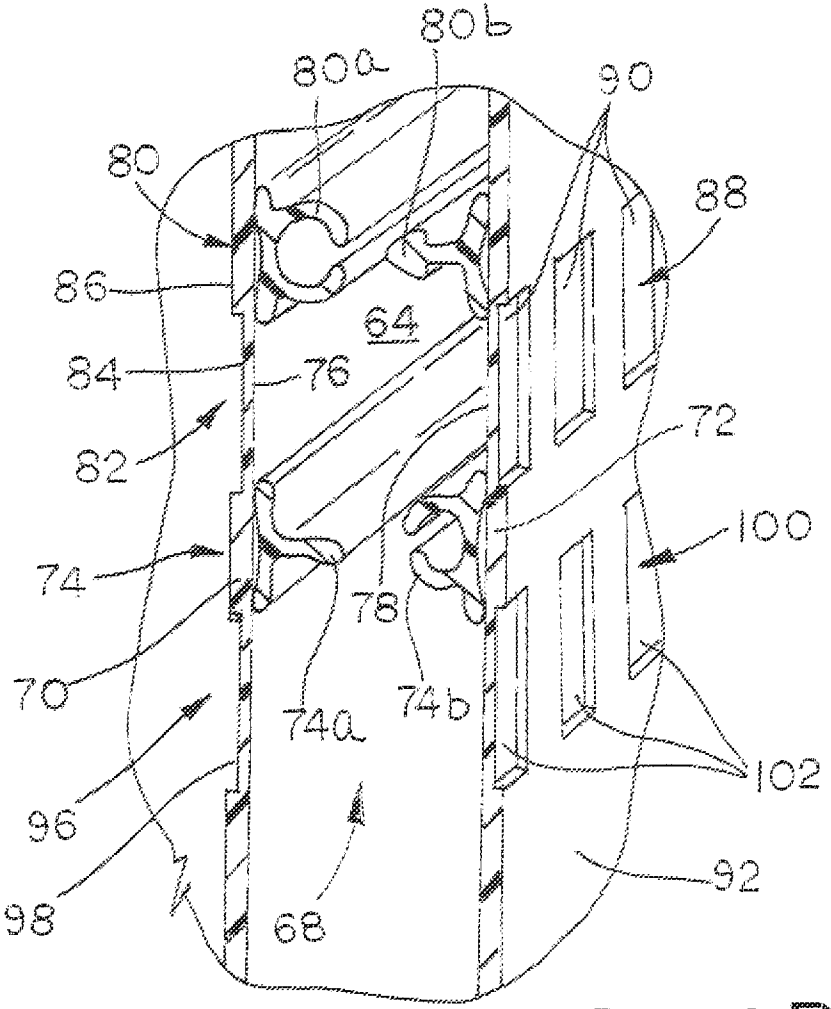
FIG. 2B is a partial cross-sectional isometric view of a second aspect of the closure mechanism of FIG. 1. taken generally along the lines 2-2 of FIG. 1.
Figure 2A:
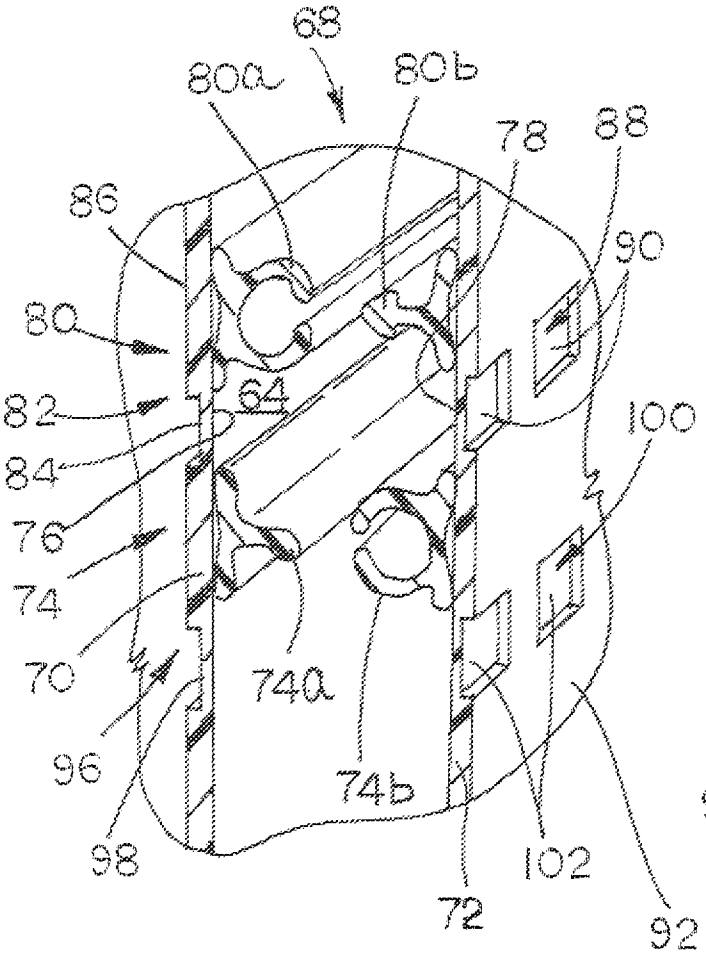
FIG. 2A is a partial cross-sectional isometric view of a first aspect of the closure mechanism of FIG. 1, taken generally along the lines 2-2 of FIG. 1.

The closure mechanism 68, in one aspect, include a first base member 70 and a second base member 72 as illustrated, for example, in FIGS. 2A and 2B. A first pair 74 of opposing interlocking members 74*a* and 74*b* project from opposing interior surfaces 76 and 78 of the base members 70 and 72, respectively. Similarly, a second pair 80 of opposing interlocking members 80*a* and 80*b* project from the opposing interior surfaces 76 and 78 of the base members 70 and 72, respectively. The second pair 80 of opposing interlocking members is parallel to and spaced on an exterior side from the first pair 74. Each pair of the opposing interlocking members 74*a* and 74*b*, and 80*a* and 80*b* includes elongate generally constant profiles disposed across the mouth 64 of the pouch 50. Each pair 74, 80 of opposing interlocking members is illustrated in FIGS. 2A and 2B as having a single male and a female profile. However, each of the pairs 74, 80 of opposing interlocking members may include one or more sets of elongate profiles, as desired, that form a seal across the mouth 64 of the pouch 50, for example, as illustrated in Pawloski et al. U.S. Pat. No. 7,437,736, Pawloski U.S. Pat. No. 7,410,298, and Dais et al. U.S. Pat. Nos. 5,070,584, 5,478,228, and 6,021,557. Further, the first and second base members 70, 72 may be integral with or separate and attached to the respective first and second sidewalls 52, 54.

In a preferred embodiment, the sidewalls 52, 54 and the closure mechanism 68 are made of thermoplastic, which may be formed by known thermoplastic extrusion and bag forming techniques, such as, disclosed in Dais et al. U.S. Pat. Nos. 5,070,584, 5,478,228, and 6,021,557, Geiger et al. U.S. Pat. No. 4,755,248, Zieke et al. U.S. Pat. No. 4,741,789, and Porchia et al. U.S. Pat. No, 5,012,461. Other materials and formation techniques sufficient to form structures as described herein are also within the general purview of the present invention.

Figure 3:
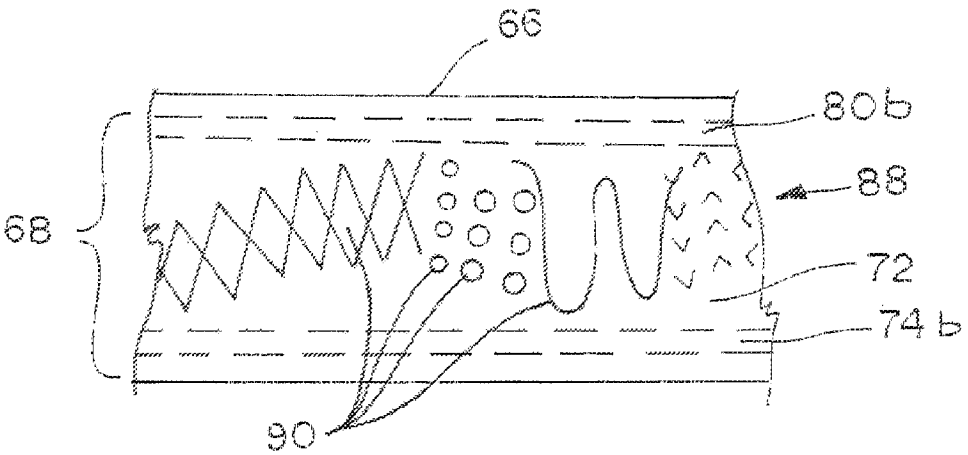
FIG. 3 is an enlarged exterior partial side view of the closure mechanism of FIG. 1.

Referring to FIGS. 1-3, a first plurality 82 of partial indentations 84 is disposed along an exterior surface 86 of the first base member 70, wherein the first plurality of partial indentations extends longitudinally along the closure mechanism 68 between the first and second pairs 74, 80 of opposing interlocking members. A second plurality 88 of partial indentations As may optionally be disposed along an exterior surface 92 of the second base member 72, wherein the second plurality of partial indentations also extends longitudinally along the closure mechanism between the first and second pairs 74, 80 of opposing interlocking members.

In one aspect, each plurality 82, 88 of partial indentations is arranged in a generally linear pattern extending completely from the peripheral edge 56 to the peripheral edge 60, as illustrated for the pluralities 82 and 88 of partial indentations in FIG. 1. However, each plurality 82, 88 of partial indentations may extend partially across the sidewalls 52, 54 or may be broken up into regions including indentations and regions lacking indentations (not shown). Further, each plurality 82, 88 of partial indentations may be arranged in a curvilinear pattern between the peripheral edges 56, 60, as illustrated for the plurality 88 of partial indentations in FIG. 3, or may be alternatively arranged as a mix of generally linear and curvilinear patterns.

The partial indentations 84, 90 that make up the first and second pluralities 82 and 88, respectively, may be generally linear, generally curvilinear, or may have shapes having generally linear and/or curvilinear perimeters. The partial indentations 84, 90 may be manufactured, in one preferred method, for example, using a double roller mechanism applied to create the partial indentations 84, 90, wherein the double roller mechanism includes a first roller wheel with cutting and/or embossing surfaces applied to the exterior surfaces 86, 92 and a second roller wheel with a smooth surface of a rubber or hard metal such as steel, applied opposite to the first roller wheel. In another method, a double roller having complimentary opposing male and female embossing surfaces may be used to create the partial indentations 84, 90. Alternatively, the double roller mechanism, may be applied such that the embossing surfaces thereon are applied to interior surfaces of the first and second base members 70, 72.

The partial indentations 84, 90 do not extend completely through the respective first and second base members 70 and 72. Rather, each of the partial indentations 84, 90 extends only part way through the corresponding base member, thereby not allowing any leakage therethrough. The partial indentations 84, 90 may touch each other, as shown, for example, in FIG. 1 as overlapping offset zigzag or interlocking diamond shapes, which according to one preferred aspect, is used for the indentations 84. 90 of one or more of the pluralities of indentations 82, 88. Alternatively, the partial indentations 84, 90 may be spaced apart from each other longitudinally, as shown, for example, in FIGS. 2 and 4, such that spacing between longitudinally spaced partial indentations 84, 90 may be constant or variable along the first and/or second pluralities 82, 88, respectively. The partial indentations 84, 90 may include longitudinally spaced apart transverse linear indentations and/or may include indicia, such as words, logos, or other informational patterns, and may be selected for aesthetics of the pattern or to enhance the tactile sensation imparted to a user's fingers. FIG. 3 illustrates some other exemplary possible patterns that may be utilized for the partial indentations 84, 90, such as wavy Hues, and longitudinally spaced sets of transversely aligned circles.

In one embodiment, illustrated in FIGS. 1 and 2A, the exterior surfaces 86, 92 of the respective first and second base members 70, 72 do not have indentations and are therefore, smooth in regions that are directly opposite to or coextensive with the pairs of opposing interlocking members 74, 80. Thus, a transverse space Is formed between each of the pluralities 82, 88 of the longitudinally spaced partial indentations 84, 90, respectively, and each adjacent interlocking member. In another embodiment, illustrated in FIG. 2B, regions that are directly opposite to or coextensive with the pairs of interlocking members 74, 80 are adjacent to or may slightly overlap with uppermost and lowermost extremes of the pluralities 82, 88 of the longitudinally spaced partial indentations 84, 90, respectively.

Figure 4:
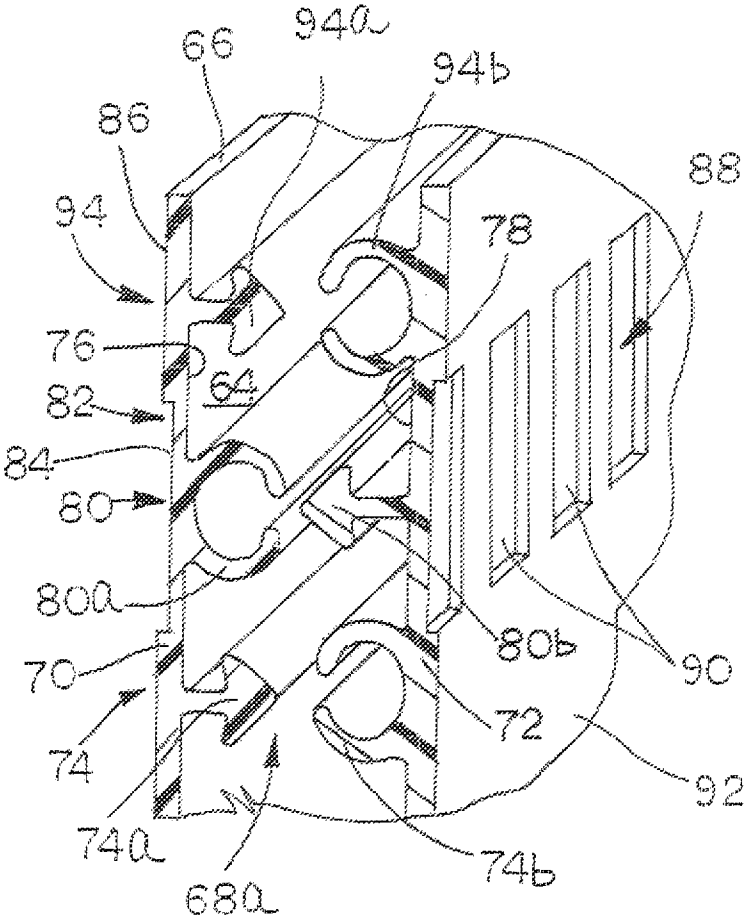
FIG. 4 is an isometric partial cross-sectional view of a closure mechanism according to another aspect of the invention, taken generally along the lines 2-2 of FIG. 1.

In another aspect, a closure mechanism 68*a* optionally includes a third pair 94 of opposing interlocking members 94*a* and 94*b* projecting from the opposing interior surfaces 76 and 78 of the base members 70 and 72, respectively, as shown in FIG. 4. The third pair 94 of the opposing interlocking members is parallel to and spaced from the second pair 80 on an opposite side thereof from the first pair 74 of opposing interlocking members. In this aspect, the first and second pluralities 82, 88 of partial indentations 84, 90, respectively, are disposed along the respective exterior surfaces 86, 92 of the respective first and second base members 70, 72 coincident with the second pair 80 of opposing interlocking members and transversely spaced between the first pair 74 and the third pair 94 of interlocking members. It is contemplated that further aspects may include more than three pairs of opposing interlocking members, as desired.

It is contemplated that a third plurality 96 of partial indentations 98 may be disposed along an exterior surface 86 of the first base member 70, wherein the third plurality 96 of partial indentations 98 extends longitudinally along the closure mechanism 68 below the lowermost pair of opposing interlocking members, for example, the first pair 74 of opposing interlocking members. Similarly, a fourth plurality 100 of partial indentations 102 may be disposed along an exterior surface 92 of the second base member 72, wherein the fourth plurality 100 of partial indentations 102 extends longitudinally along the closure mechanism 68 below the lowermost pair of opposing interlocking members, for example, the first pair 74 of opposing interlocking members. Similar to die first and second pluralities 82, 88, the third and fourth pluralities 96, 100 of partial indentations 98, 102, respectively, may be longitudinally continuous or longitudinally spaced. In one embodiment, illustrated in FIG. 2A, the third plurality 96 of partial indentations 98 is transversely spaced from a bottom edge of the first pair 74 of opposing interlocking members. In another embodiment, illustrated in FIG. 2B, a top edge of the third plurality 96 of partial indentations 98 is adjacent to or may slightly overlap with a bottom edge of the first pair 74 of opposing interlocking members.

Figure 5:
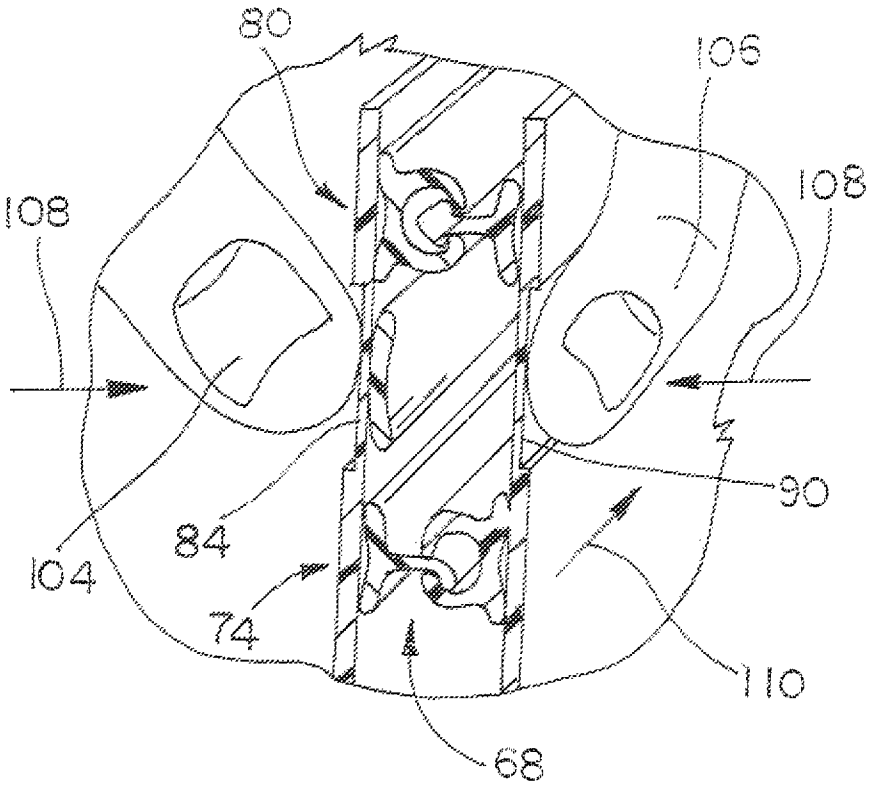
FIG. 5 is an isometric partial cross-sectional view of a user's fingers engaging the closure mechanism of FIG. 1 in one possible method of using the pouch of the present invention.

In use, each of the first and second pluralities 82, 88 of the partial indentations 84, 90, respectively, can provide a tactile guide path tor a user's finger to facilitate proper occlusion of the closure mechanism 68. Referring to FIGS. 2A, 2B and 5, to occlude the closure mechanism 68 that includes the first plurality 82 of the partial indentations 84, a user grasps the closure mechanism 68, for example, between a first finger 104 and a second finger 106, lire user locates the first finger 104 between the first and second spaced apart pairs 74, 80 of opposing interlocking members by feeling whether the first finger 104 is engaged against the first plurality 82 of the partial indentations 84. The second finger 106 is located on the exterior surface 92 of the second base 72 opposite to the first finger 104. Thus grasped, the user forces the first and second opposing fingers 104, 106, together as indicated by the arrows 108 shown in FIG. 5, to locally occlude the first and second spaced apart pairs 74, 80 of opposing interlocking members that are disposed on either side of the user's fingers. The user slides the first and second opposing fingers 104, 106 along the closure mechanism 68, as Illustrated by die arrow 110 shown in FIG. 5, with the first and second fingers 104, 106 forced together, such that the first finger 104 Is guided by the first plurality 82 of the partial indentations 84. The user maintains the first finger 104 between the first and second spaced apart pairs 74, 80 of opposing interlocking members, while sliding the first and second fingers 104, 106 by feeling the first plurality 82 of the partial indentations 84 with the first finger 104, whereby the first and second spaced apart pairs 74, 80 of opposing interlocking members are occluded along their entire length, and the mouth 64 is sealed.

Industrial Applicability

A closure mechanism has been presented that may be used on reclosable thermoplastic pouches and that includes a tactile guide path. The tactile guide path may facilitate proper occlusion of the closure mechanism by guiding one or more of a user's lingers along a preferred path along the length of the closure mechanism.

It is also contemplated that regions adjacent to and between the pairs of opposing interlocking members 74, 80 may be thicker than, and, therefore, stiffer than, the pouch sidewalls 52, 54 or other portions of the closure mechanism 68. Without being bound by theory, it is believed that embossing and/or creation of the partial indentations in the above-noted regions may increase the pliability of the above-noted regions over a base that does not have such partial indentations, which can feel better to a user and can make the opposing interlocking members 74, 80 easier to occlude.

Numerous modifications to the present invention will be apparent to those skilled in the art in view of the foregoing description. Accordingly, this description is to be construed as being illustrative only and is presented for the purpose of enabling those skilled in the art to make and use the invention, and to teach the best mode of carrying out the same. The exclusive right to all modifications within the scope of the impending claims is expressly reserved. All patents, patent publications and applications, and other references cited herein are incorporated by reference herein in their entirety.

We claim:

1. A reclosable pouch in combination with an elongate closure mechanism, the reclosable pouch comprising:

(a) first and second sidewalls, the first and second sidewalls being connected together in order to define an interior space of the pouch between the first and second sidewalls, and a mouth defining an opening into the interior space; and (b) an elongate closure mechanism disposed along the first and second sidewalls for resealably closing the mouth, the elongate closure mechanism extending longitudinally from one end of the mouth to an opposite end of the mouth, the elongate closure mechanism comprising:

(i) a first base member disposed along the first sidewall;

(ii) a pair of interlocking members extending from a first surface of the first base member, the pair of interlocking members being parallel to each other with a space therebetween, and the pair of interlocking members having constant profiles between opposite ends of the elongate closure mechanism;

(iii) a plurality of partial indentations being disposed along a second surface of the first base member at positions opposite to the space between the pair of interlocking members, the plurality of partial indentations extending longitudinally between the opposite ends of the elongate closure mechanism and being visible between the opposite ends of the elongate closure mechanism;

(iv) a second base member disposed along the second sidewall; and (v) a pair of interlocking members extending from a surface of the second base member, the pair of interlocking members being parallel to each other with a space therebetween, and the pair of interlocking members having constant profiles between opposite ends of the elongate closure mechanism, wherein the pair of interlocking members extending from the first base member are configured to occlude and deocclude with the pair of interlocking members extending from the second base member, in order to resealably close the mouth, and wherein the plurality of partial indentations remains visible during occluding and deoccluding of the pair of interlocking members extending from the first base member with the pair of interlocking members extending from the second base member to provide a tactile guide path to facilitate a user in the occluding of the pair of interlocking members extending from the first base member with the pair of interlocking members extending from the second base member.

2. The reclosable pouch of claim 1, wherein the surface of the second base member is a first surface of the second base member, and wherein a plurality of partial indentations is disposed along a second surface of the second base member at positions opposite to the space between the pair of interlocking members extending from the first surface of the second base member.

3. The reclosable pouch of claim 1, wherein the plurality of partial indentations comprises a plurality of longitudinally spaced apart partial indentations.

4. The reclosable pouch of claim 1, further including a second plurality of partial indentations disposed along the second surface of the first base member at positions below the pair of interlocking members extending from the first surface of the first base member.

5. The reclosable pouch of claim 1, wherein the plurality of partial indentations comprises a linear pattern of interlocking diamond shapes.

6. The reclosable pouch of claim 1, wherein the plurality of partial indentations is arranged in a generally curvilinear pattern along the second surface of the first base member.

7. The reclosable pouch of claim 6, wherein at least some of the partial indentations are generally diamond shaped.

8. The reclosable pouch of claim 1, wherein each partial indentation of the plurality of partial indentations touches an adjacent partial indentation of the plurality of partial indentations.

* * * * *